US008113880B2

(12) United States Patent
Cappe et al.

(10) Patent No.: US 8,113,880 B2
(45) Date of Patent: Feb. 14, 2012

(54) ELECTRICAL CONNECTOR

(75) Inventors: Patrice Cappe, Faverolles (FR); Michel Lecuivre, Troarn (FR); Christian Campfort, Fresnay le Gilmert (FR)

(73) Assignee: FCI Automotive Holding, Guyancourt (FR)

( * ) Notice: Subject to any disclaimer, the term of this patent is extended or adjusted under 35 U.S.C. 154(b) by 89 days.

(21) Appl. No.: 12/227,202

(22) PCT Filed: May 12, 2006

(86) PCT No.: PCT/EP2006/007974

§ 371 (c)(1),
(2), (4) Date: Jun. 4, 2010

(87) PCT Pub. No.: WO2007/131539

PCT Pub. Date: Nov. 22, 2007

(65) Prior Publication Data

US 2010/0240252 A1 Sep. 23, 2010

(51) Int. Cl.
*H01R 13/40* (2006.01)

(52) U.S. Cl. ..... 439/587; 439/274

(58) Field of Classification Search ..... 439/352, 439/595, 274, 275, 589, 467–472, 499, 587
See application file for complete search history.

(56) References Cited

U.S. PATENT DOCUMENTS

| | | | | |
|---|---|---|---|---|
| 5,074,803 | A * | 12/1991 | Chandler et al. | 439/347 |
| 5,928,033 | A * | 7/1999 | Kato et al. | 439/587 |
| 6,142,825 | A * | 11/2000 | Shinchi | 439/587 |
| 6,302,733 | B1 * | 10/2001 | Sakaguchi et al. | 439/587 |
| 6,302,734 | B1 | 10/2001 | Ichio et al. | 439/587 |
| 6,343,952 | B1 * | 2/2002 | Fukuda | 439/587 |
| 6,485,333 | B1 * | 11/2002 | Shinchi | 439/587 |
| 2005/0020131 | A1 * | 1/2005 | Beck et al. | 439/587 |
| 2005/0221672 | A1 * | 10/2005 | Tsuchjya et al. | 439/587 |

FOREIGN PATENT DOCUMENTS

| | | |
|---|---|---|
| DE | 100 45 714 A1 | 5/2001 |
| DE | 203 19 011 U1 | 5/2005 |
| EP | 0 978 907 A1 | 2/2000 |
| WO | WO 96/29760 | 9/1996 |

* cited by examiner

*Primary Examiner* — Renee Luebke
*Assistant Examiner* — Larisa Tsukerman
(74) *Attorney, Agent, or Firm* — Harrington & Smith

(57) ABSTRACT

The electrical connector includes an insulating housing, for receiving at least one electrical contact terminal connected to a cable, wherein at least one terminal accommodating chamber is formed, said insulating housing including a front face intended to mate with a counterpart connector, and a rear wall provided with a rear slot for introducing each terminal in the respective chamber. It further including a sealing deformable material facing the rear wall, and a press for pressing the sealing deformable material against the rear wall. The press comprises a flap connected to the housing so as to be able to rotate between an open position in which access to the rear slot is allowed, and a closed position in which the flap presses the sealing deformable material against the rear wall, so that the sealing deformable material deforms in order to sealingly close the rear slot and come into contact with the cable when it is inserted.

17 Claims, 5 Drawing Sheets

ELECTRICAL CONNECTOR

BACKGROUND OF THE INVENTION

The invention relates to electrical connectors for receiving contact terminals and mating with a complementary connector in order to connect the contact terminals.

More precisely, the invention relates to an electrical connector comprising:

an insulating housing, for receiving at least one electrical contact terminal connected to a cable, wherein at least one terminal accommodating chamber is formed, said insulating housing comprising a front face intended to mate with a counterpart connector, and a rear wall provided with a rear slot for introducing each terminal in the respective chamber:

a sealing deformable material facing the rear wall, and a means for pressing the sealing deformable material against the rear wall.

Such an electrical connector is known from EP 0 948 090 A1. In this document, the sealing deformable material is made of gel of silicon or low-hardness rubber and is pierced by two slots, each for letting pass a raw of cables. The pressing means comprises a grid covering the sealing deformable material and able to slide frontward to press the sealing deformable material against the rear wall. The grid comprises frontward projections forcibly inserted into corresponding slits provided with in the sealing deformable material, so that it is deformed laterally in order to cover the slots and comes into contact with each wire.

The known electrical connector requires applying a great force on the grid in order to ensure that the projections enter the slits.

SUMMARY OF THE INVENTION

The present invention aims at eliminating the drawbacks found in the above-mentioned conventional electrical connector.

Accordingly, there is provided an electrical connector according to claim 1.

According to the invention, the sealing deformable material is efficiently pressed against the rear wall by use of lever arm effect. This allows to get rid of the projections and slits, as the force pressing the sealing deformable material against the rear wall is strong enough to ensure sufficient deformation for a good sealing effect.

Different embodiments of the device may comprise any of the features, individually or in any technically feasible combination, corresponding to claims 1-11.

Now, description will be given below in detail of an electrical connector according to the invention with reference to FIGS. 1 to 10.

DESCRIPTION OF THE PREFERRED EMBODIMENTS

Figure 1:
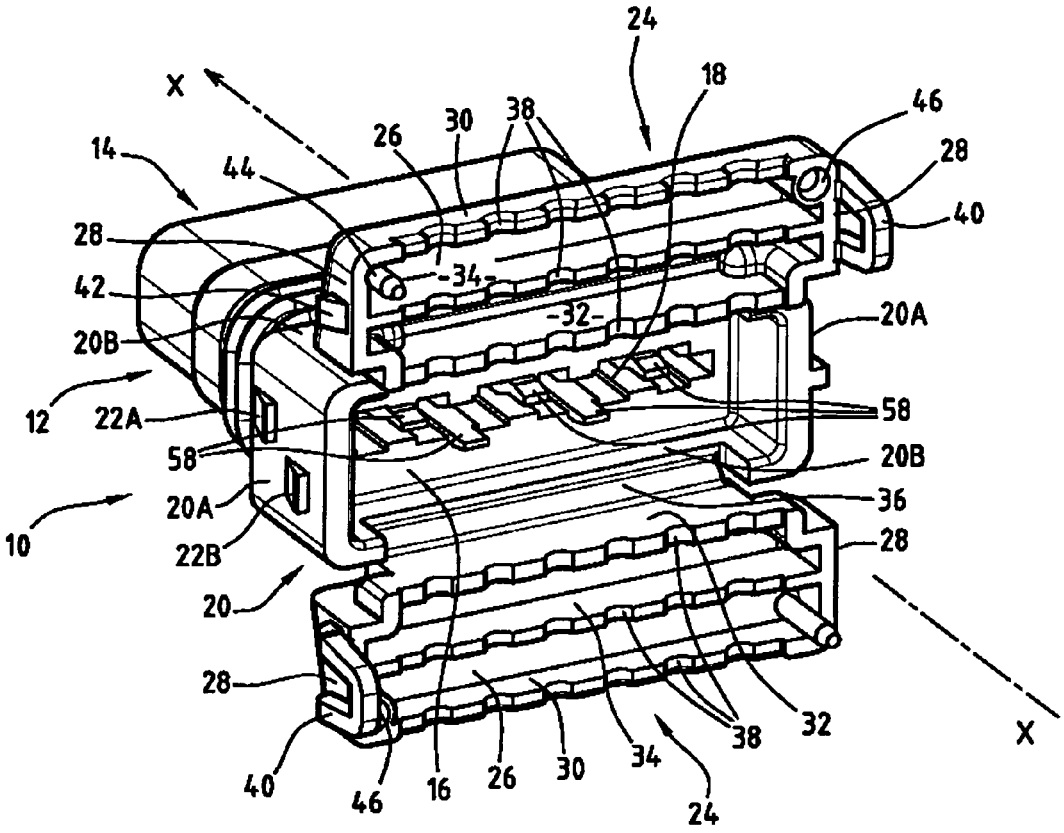
FIG. 1 is a perspective view of an electrical connector according to a first embodiment of the invention, without sealing deformable material and flat cable.

The connector 10 shown on FIG. 1 is of a type used in an automotive application, and is intended to mate with a counterpart connector (not shown).

The mating direction is referenced as XX' axis, which is oriented from the connector 10 towards the counterpart.

The orientation or position terms used in the present description refer to this mating axis XX'. In particular, the terms "forward" or "front" are read as oriented with regard to the mating direction.

The electrical connector 10 comprises a housing 12 formed of insulating material in a substantially rectangular cylinder shape extending along the XX' axis.

The insulating housing 12 comprises a rectangular front face 14 intended to mate with the counterpart connector (not shown).

The housing 12 further comprises a rectangular rear wall 16 opposed to the front face 14. The rear wall 16 is provided with a slot-shaped rear opening 18 extending along its length, through which for instance a flat cable is intended to be inserted.

In the invention, flat cable means generally any kind of cable formed by a plurality of parallel electrical wires fixed together in an insulating ribbon. The electrical wires can be flat (in the case of strip wires) or have any other cross sectional area (i.e. circular). Further, instead of a flat cable, independent wires (either insulated or not) or a combination of a flat cable and independent wires, may be inserted through the opening 18.

The housing 12 further comprises a peripheral wall 20 extending rearward from and surrounding the rear wall 16. The peripheral wall 20 includes two opposed short side walls 20A and two opposed long side walls 20B. The two long side walls 20B are parallel to the slot 18 and have a height lower than the height of the two short side walls. Each short side wall 20A carries two outer stop lugs, a front stop lug 22A and a rear stop lug 22B. Each long side wall 20B carries a half jaw 24 intended to cover each side of the inserted flat cable. The half jaws 24 are symmetrically disposed.

Each half jaw 24 comprises a rectangular top wall 26, two lateral walls 28, and three projecting portions 30, 32, 34, the side walls 28 and the projecting portions 30, 32, 34 extending perpendicular to the top wall 26. The top wall 26 is integral with and extends the long side wall 20B.

Each half jaw 24 is connected to the housing 12 by a hinge 36, which extends along an axis parallel to the slot 18. In the illustrated example, the hinge 36 is formed, in an open position, by a substantially right angle bending, between the top wall 26 and the long side wall 20B. In the open position, the half jaws 24 allows access to the rear slot 18.

Each lateral wall 28 extends along a respective side of the top wall 26 starting off from the hinge 36. The housing 12, the peripheral wall 20, the hinge 36 and the half jaws 24 are preferably integral with each other, and obtained by molding a single piece.

All projecting portions 30, 32, 34 extend from a side wall 28 to the other, and are parallel to the hinge 36. The first projecting portion 30 is located at a free end of the top wall 26 opposed to the hinge 36, whereas the second projecting wall 32 is located at its base, i.e. near the hinge 36. This second projecting portion 32 forms a flap able to rotate around the hinge 36. The third projecting wall 34 is located halfway between the two others. Each projecting portion 30, 32, 34 has a side opposite the top wall 26 provided with notches 38 for letting pass wires.

For each half jaw 24, a lateral wall 28 carries on its outside surface a hook 40 having the shape of a handle perpendicular to the top wall 26, whereas the other side wall 28 carries on its outside surface a lug 42, for receiving the hook 40 of the other half jaw 24.

Each half jaw 24 further comprises a centering pin 44 extending along the lateral wall 28, and defines a pin hole 46 for receiving the centering pin 44 of the other half jaw 24.

Figure 2:
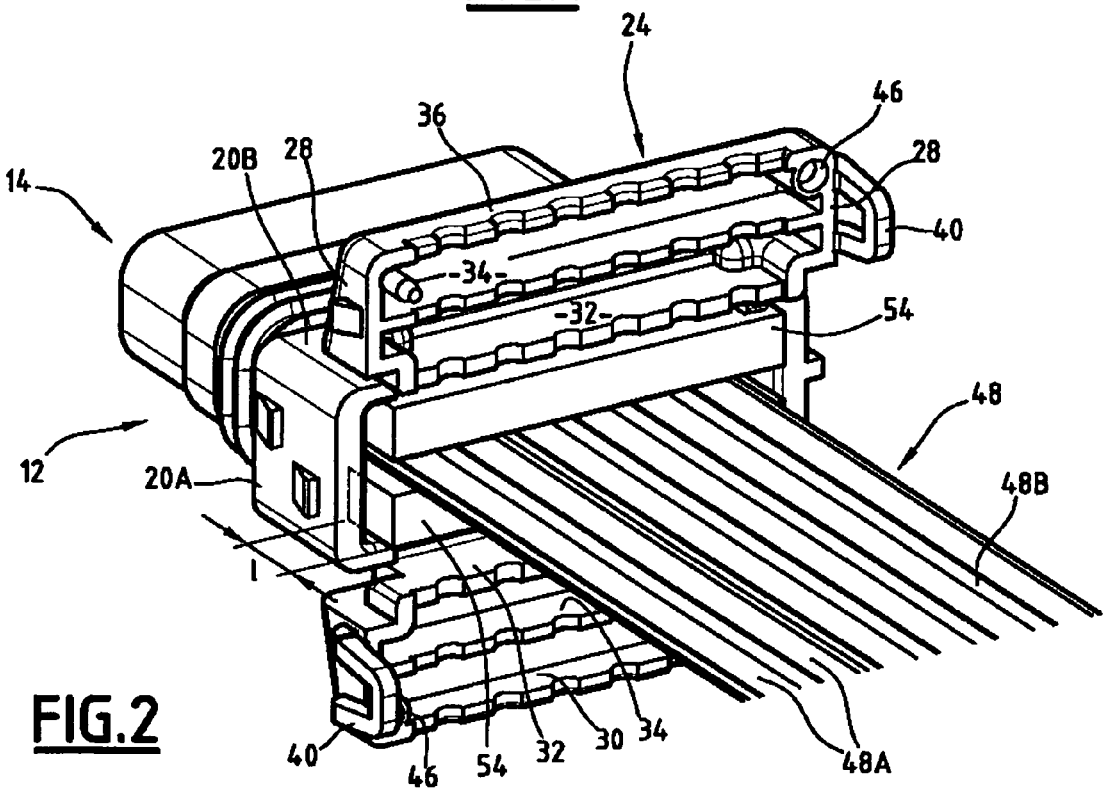
FIG. 2 is a view similar to FIG. 1, with sealing deformable material.
Figure 3:
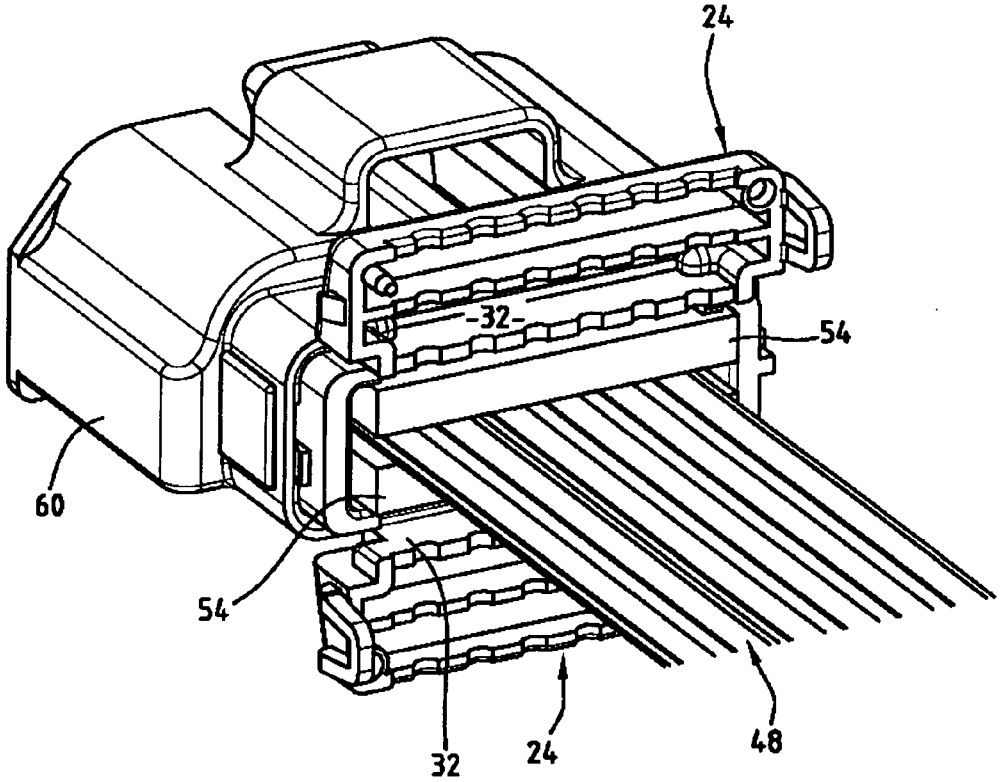
FIG. 3 is a view similar to FIG. 2, with a locking ring.
Figure 4:
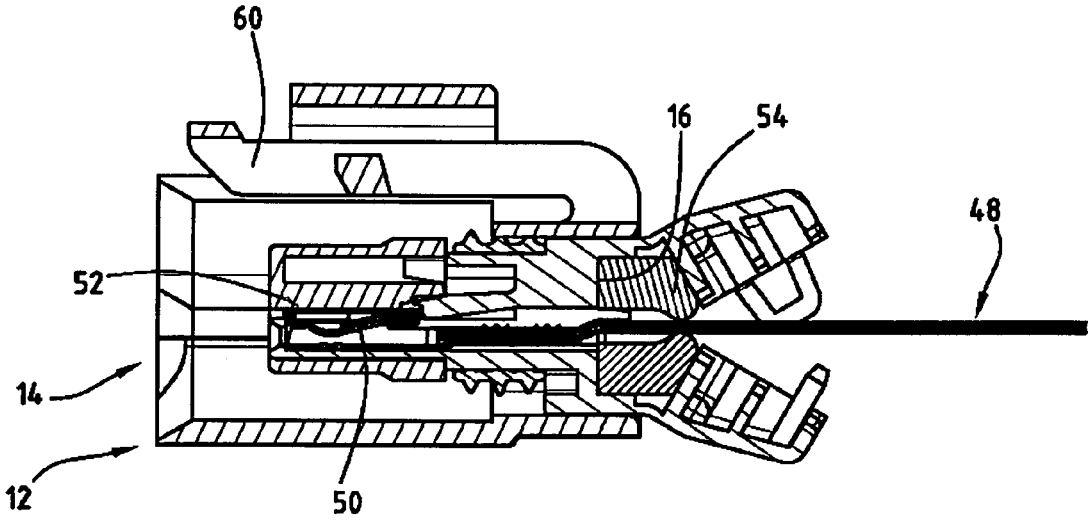
FIGS. 4 to 6 are section views of the electrical connector of FIG. 3 in operation.
Figure 5:
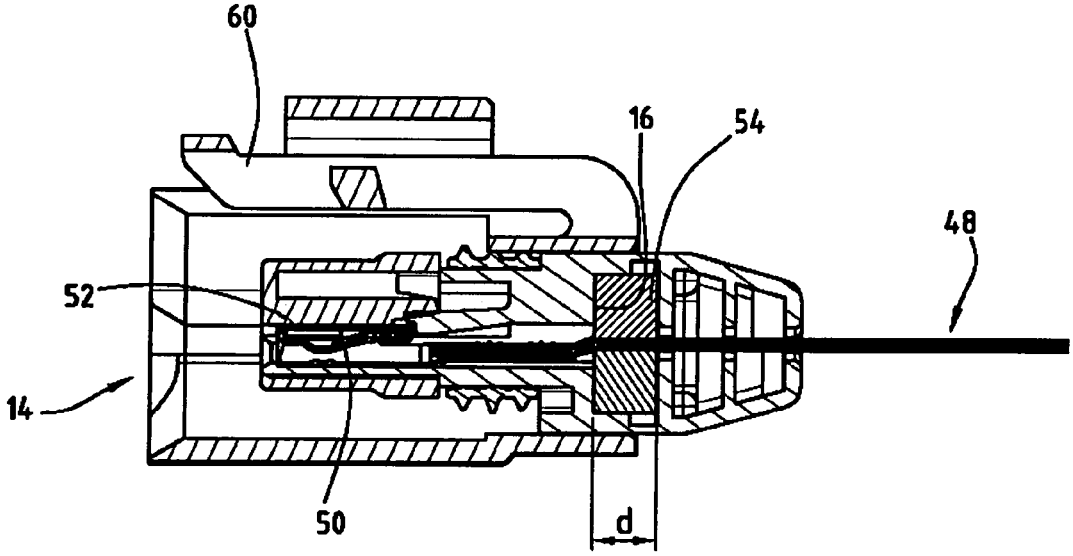
Figure 6:
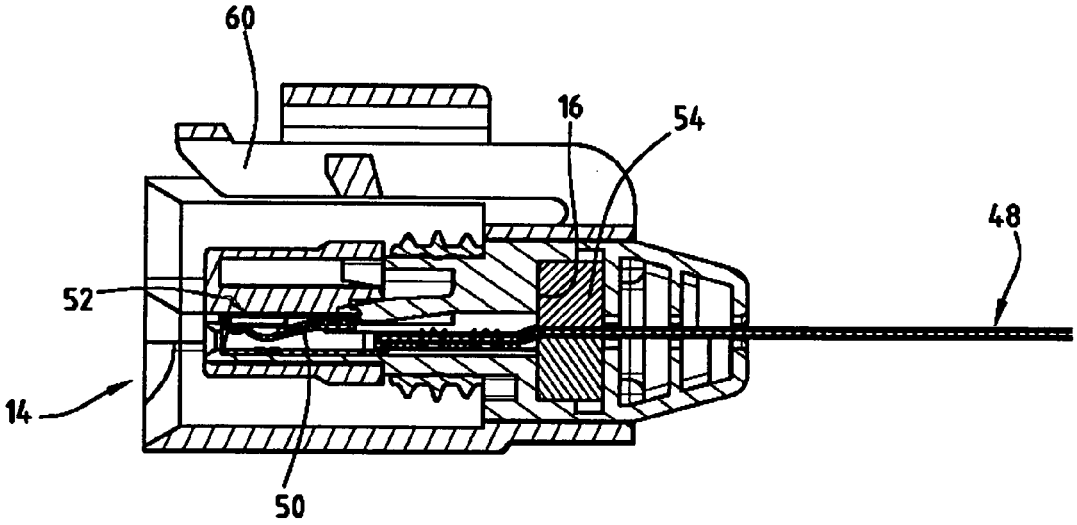
Figure 7:
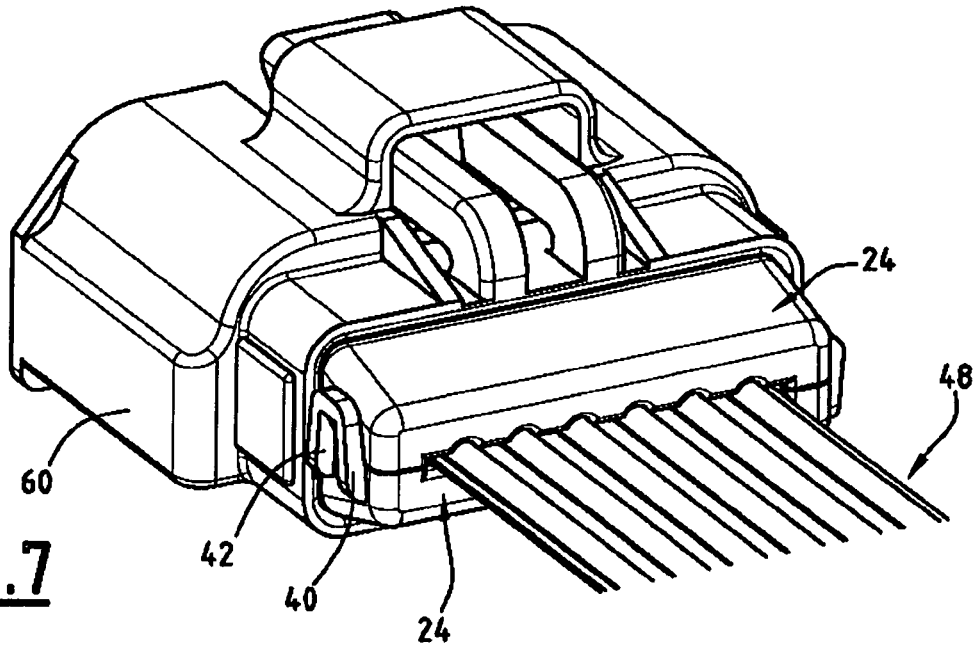
FIG. 7 is a perspective view of the electrical connector of FIG. 1 in a closed and locked position.

Referring now to FIGS. 2, 3 and 4, a flat cable 48 is inserted through the rear slot 18 by an end carrying electrical contact terminals 50 (see FIG. 4). The flat cable 48 includes parallel electrical wires 48A, leading each to one electrical contact terminal 50 (FIG. 4), fixed together with a ribbon 48B of elastomer. The contact terminals 50 are received in chambers 52 provided in the housing 12 (FIG. 4). The front face 14 leads to the electrical contact terminals 50 in order to be accessed by the counterpart connector (not shown).

Sealing deformable material in the form of two slabs of gel 54 is intended to ensure sealing in order to prevent water, dust or the like from entering the housing 12 through the slot 18. Each slab of gel 54 is disposed against the rear wall 16, along and on one side of the slot 18. In order to avoid that the slabs of gel 54 move and obstruct the slot 18 before the flat cable is inserted, the electrical connector 10 comprises a means 56 for maintaining the slabs of gel 54 adjacent to the slot 18. The maintaining means 56 includes five lugs 58 as shown on FIG. 1, extending from the rear wall 16 in the vicinity of the slot 18. Two maintaining lugs 58 are located on the lower side of the slot 18, whereas three maintaining lugs 58 are located on the upper side of the slot 18, the lugs 58 being staggered on either side of the slot 18. The slabs of gel 54 extend in the space delimitated between the maintaining lugs 58 and the peripheral wall 20, which holds laterally the slabs of gel 54. Each slab of gel 54 has a longitudinal dimension l slightly superior to the height of the peripheral wall 20. The gel is obtained from silicon or elastomer. For instance, the gel is the one referenced GT-6201 of Dow Corning®

Referring now to FIGS. 3-7, a locking ring 60 having a substantial cylinder shape surrounds the housing 12. The locking ring 60 is located before the hinge 36 and is able to slide rearward on the housing 12. Its frontward movement is blocked by the front stop 22A (see FIG. 1).

Referring now to FIGS. 4 to 7, operation of the electrical connector 10 is explained.

Starting from their open position, the two half jaws 24 are pivoted around the hinge 36, towards each other. Each flap 32 rotates towards the other, and presses the corresponding gel slab 54 against the rear wall 16. The gel slab 54 is then deformed and comes into contact with the flat cable (FIG. 4).

A first locking occurs when the hooks 40 engage the corresponding lug 42 of the other half jaw 24. In this closed position (FIG. 5), the flaps 32 join each other, the flat cable 48 being interposed in between, and extend parallel to the rear wall 16 at a distance d lower than the original gel slab 36 longitudinal dimension l, in order to ensure that the gel slab 54 is compressed against the rear wall 16 and the flat cable 48.

There is no clearance between the flat cable 48 and each flap 32 in closed position. Thus, the gel slabs 54 are firmly hold longitudinally: they cannot move rearward. Moreover, absence of clearance avoids vibrations of the flat cable relative to the connector 10 that could otherwise occur.

Then, the locking ring 60 is slid rearward in order to engage the rear stop lug 22B. In this locked position, the locking ring 60 covers the hinge 36 and a part of the top wall 26. Its frontward movement is blocked by the rear stop lug 22B. The locking ring prevents unwanted separation of the two half jaws 24.

Figure 8:
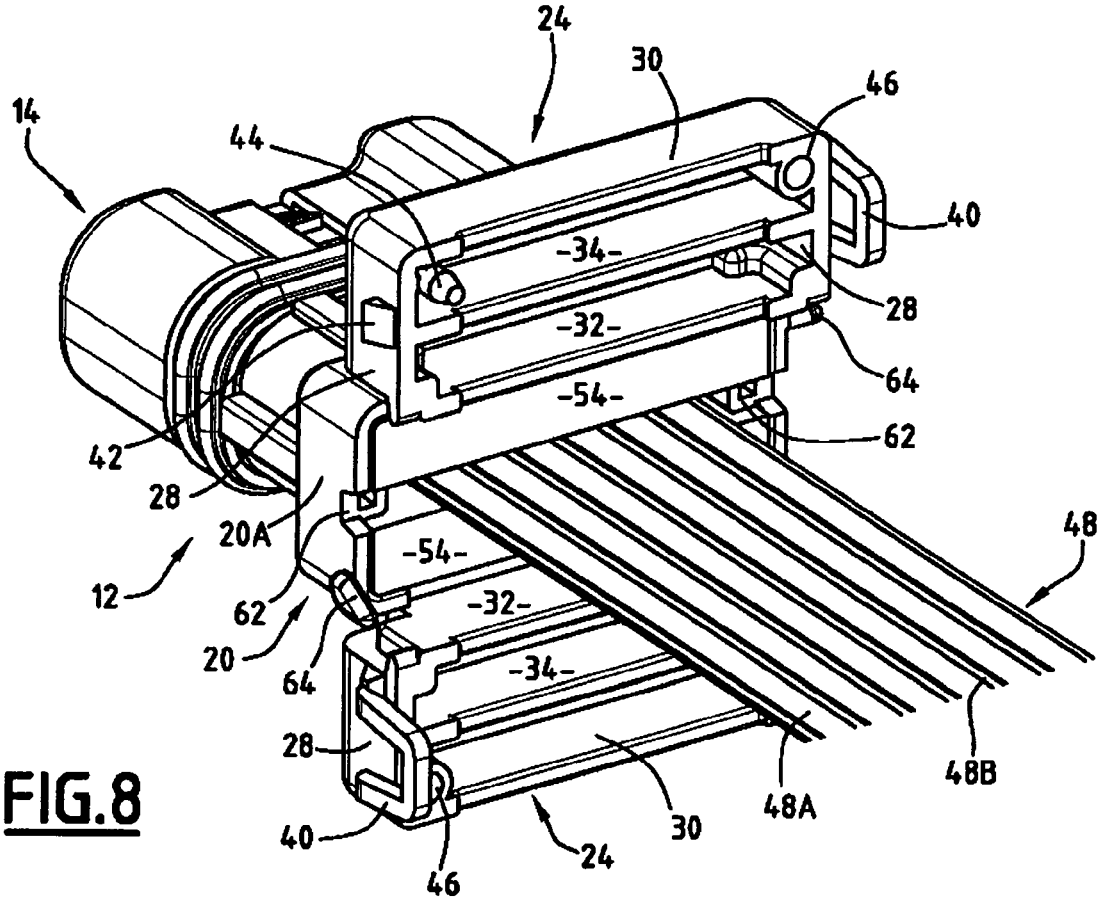
FIG. 8 is a perspective view of an electrical connector according to a second embodiment of the invention.
Figure 9:
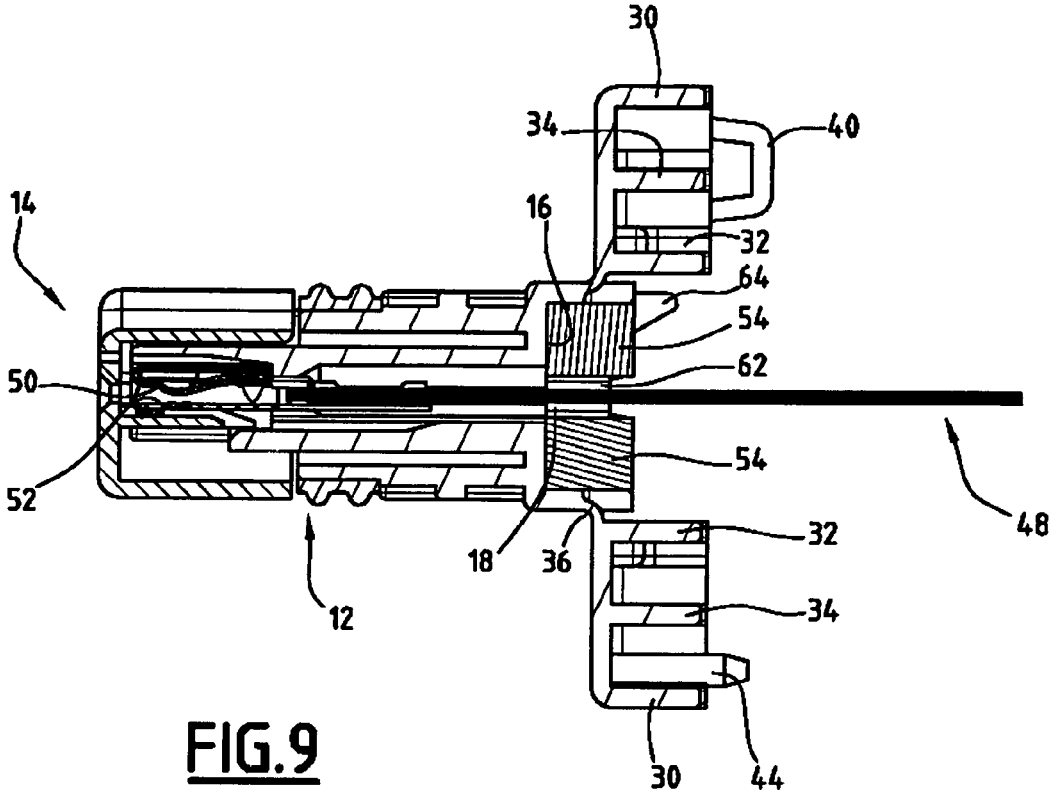
FIG. 9 is a section view of the electrical connector of FIG. 8.

Referring now to FIGS. 8 and 9, an electrical connector according to a second embodiment of the invention is shown. In this embodiment, the means for maintaining the slabs of gel 54 is formed by two inner ribs 62 each facing an end of the slot 18. The ribs 62 have a width corresponding to the width of the slot 18.

Moreover, the electrical connector comprises two outside lugs 64 each located on an outside surface of a respective short side wall 20A.

Figure 10:
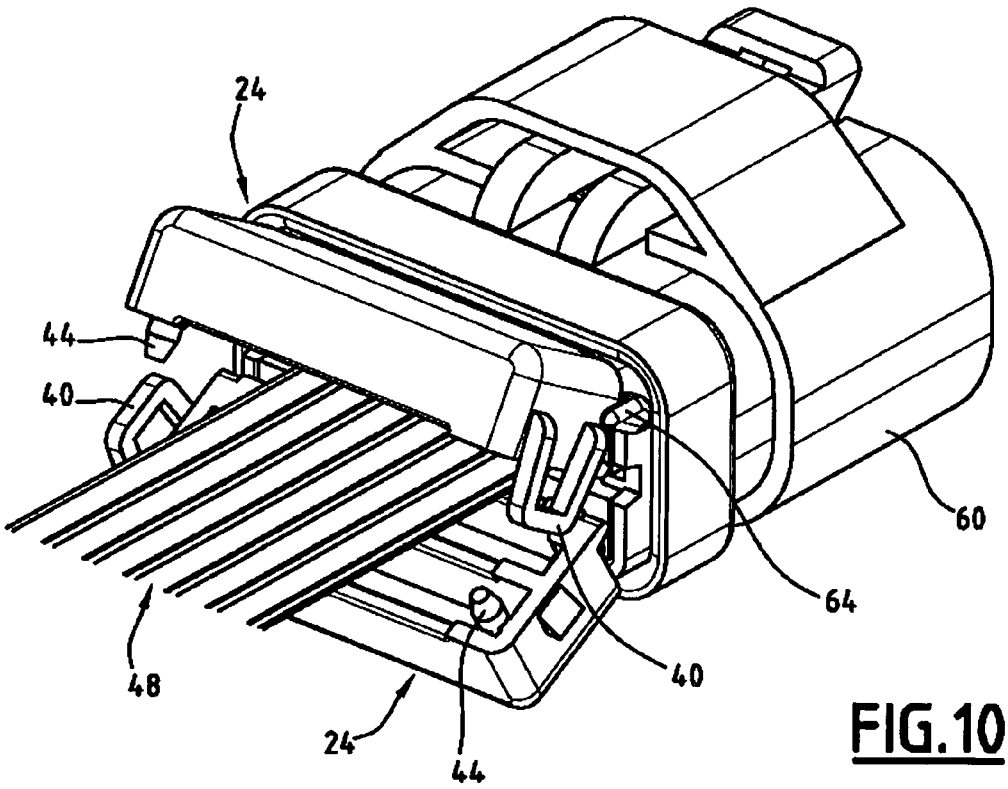
FIG. 10 is a perspective view of the electrical connector of FIG. 8 in a half closed position.

Referring now to FIG. 10, each outside lug 64 forms a stop cooperating with one of the hooks 40 in order to prevent reopening of the half jaws 24 when they are in a half closed position. In the half closed position, the flaps 32 do not press the slabs of gel 54, so that the flat cable 48 can be inserted in the slot 18. Keeping the electrical connector in the half closed position is useful to provide customers, who generally insert themselves the flat cable, with a compact electrical connector.

The invention claimed is:

1. Electrical connector comprising:

an insulating housing, for receiving at least one electrical contact terminal connected to a cable, wherein at least one terminal accommodating chamber is formed, said insulating housing comprising a front face intended to mate with a counterpart connector, and a rear wall provided with a rear slot for introducing each terminal in the respective chamber;

a sealing deformable material facing the rear wall, and a means for pressing the sealing deformable material against the rear wall, characterized in that the pressing means comprises a flap connected to the housing so as to be able to rotate between an open position in which access to the rear slot is allowed, and a closed position in which the flap presses the sealing deformable material against the rear wall, so that the sealing deformable material deforms in order to sealingly close the rear slot and come into contact with the cable when the cable is inserted, where the sealing deformable material is mounted in the insulating housing in a space adjacent the rear wall while the flap is in the open position and before the flap is moved towards the closed position.

2. Electrical connector according to claim 1, characterized in that the sealing deformable material comprises a slab of gel.

3. Electrical connector according to claim 1, characterized in that the housing comprises a peripheral wall extending perpendicular to the rear wall for holding laterally the sealing deformable material.

4. Electrical connector according to claim 3, characterized in that the peripheral wall comprises side wall on which the flap is mounted.

5. Electrical connector according to claim 1, characterized in that the flap is able to rotate around an axis parallel to the slot.

6. Electrical connector according to claim 1, characterized in that the electrical connector comprises a means for maintaining the sealing deformable material adjacent to the slot.

7. Electrical connector according to claim 6, characterized in that the maintaining means comprises at least one lug extending from the rear wall in the vicinity of the slot.

8. Electrical connector according to claim 1, characterized in that the electrical connector comprises:

two such sealing deformable material disposed on two opposite sides of the rear slot, two such flaps, rotating towards each other for pressing a respective sealing deformable material against the rear wall.

9. Electrical connector according to claim 8, characterized in that the electrical connector comprises:

two walls, each one of which being fixed to a respective flap and extending rearward when the flap presses the respective sealing deformable material, and an outer locking ring mounted around the housing and able to slide from front to rear, so as to take a locking position in which the locking ring covers the two walls at least in part.

10. Electrical connector according to claim 9, characterized in that the electrical connector comprises two top walls, each one of which being provided with a centering pin and a pin hole for receiving the centering pin of the other top wall.

11. Electrical connector comprising:

an insulating housing, for receiving at least one electrical contact terminal connected to a cable, wherein at least one terminal accommodating chamber is formed, said insulating housing comprising a front face intended to mate with a counterpart connector, and a rear wall provided with a rear slot for introducing each terminal in the respective chamber:

a sealing deformable material facing the rear wall, and a means for pressing the sealing deformable material against the rear wall, characterized in that the pressing means comprises a flap connected to the housing so as to be able to rotate between an open position in which access to the rear slot is allowed, and a closed position in which the flap presses the sealing deformable material against the rear wall, so that the sealing deformable material deforms in order to sealingly close the rear slot and come into contact with the cable when the cable is inserted, where the housing comprises a peripheral wall extending perpendicular to the rear wall for holding laterally the sealing deformable material, characterized in that the maintaining means comprises two inner ribs carried by the peripheral wall, each rib facing an end of the slot and having a width corresponding to or greater than the width of the slot and that the electrical connector comprises a means for maintaining the sealing deformable material adjacent to the slot.

12. Electrical connector comprising:

an insulating housing for receiving at least one electrical contact terminal and an electrical cable, where the insulating housing comprises at least one terminal accommodating chamber, where the insulating housing comprises a front face configured to mate with a counterpart connector, and a rear wall provided with a rear slot for introducing the cable and the at least one electrical contact terminal;

a sealing deformable material facing the rear wall; and means for pressing the sealing deformable material against the rear wall and against the cable, where the pressing means comprises a flap connected to the housing so as to be able to rotate between an open position in which access to the rear slot is allowed, and a closed position in which the flap presses the sealing deformable material against the rear wall and the cable, where the sealing deformable material deforms in order to sealingly close the rear slot and come into contact with the cable, where the means for pressing is configured to press the sealing deformable material against the rear wall before the sealing deformable material contacts the cable.

13. Electrical connector comprising:

an insulating housing, for receiving at least one electrical contact terminal connected to a cable, where at least one terminal accommodating chamber is formed, where the insulating housing comprises a front face configured to mate with a counterpart connector, and a rear wall provided with a rear slot for introducing each terminal in the respective chamber; and a sealing deformable material facing the rear wall, where the insulating housing comprises at least one flap configured to press the sealing deformable material against the rear wall, where the at least one flap is connected to the insulating housing to rotate between an open position in which access to the rear slot is allowed, and a closed position in which the flap presses the sealing deformable material against the rear wall, where the sealing deformable material is configured to be compressed between the flap and the rear wall in order to sealingly close the rear slot and come into contact with the cable, where the sealing deformable material is mounted in the insulating housing in a space adjacent the rear wall while the at least one flap is in the open position and before the at least one flap is moved towards the closed position.

14. Electrical connector according to claim 13, where the insulating housing comprises two inner ribs carried by a peripheral wall, each rib facing an end of the slot and having a width corresponding to or greater than a width of the slot, and that the electrical connector comprises a means for maintaining the sealing deformable material adjacent to the slot.

15. Electrical connector according to claim 13, where the insulating housing comprises at least one lug extending from the rear wall at the slot which holds the sealing deformable material in the space between the at least one lug and an inside surface of peripheral wall of the insulating housing.

16. Electrical connector comprising:

an insulating housing configured to receive at least one electrical contact terminal connected to a cable, where the insulating housing comprises at least one terminal accommodating chamber, where the insulating housing comprises a front face intended to mate with a counterpart connector, and a rear wall provided with a rear slot for introducing each terminal in the respective terminal accommodating chamber;

a sealing deformable material connected to the insulating housing; and a flap connected to the housing and configured to rotate between an open position, in which access to the rear slot is allowed, and a closed position, in which the flap presses the sealing deformable material against the rear wall, where, when the cable is inserted in the rear slot and the flap is moved to the closed position, the flap and the sealing deformable material are configured to deform the sealing deformable material against the rear wall, to come into contact with the cable, and to sealingly close the rear slot.

17. Electrical connector according to claim 16 where the sealing deformable material faces the rear wall when the flap is in the open position.

* * * * *